United States Patent [19]

Wilson

[11] Patent Number: 4,459,905

[45] Date of Patent: Jul. 17, 1984

[54] CAN CRUSHER

[75] Inventor: Richard C. Wilson, Champlin, Minn.

[73] Assignee: Tie Down Engineering, Inc., Atlanta, Ga.

[21] Appl. No.: 402,090

[22] Filed: Jul. 26, 1982

[51] Int. Cl.[3] ..... B30B 9/32

[52] U.S. Cl. ..... 100/35; 100/233; 100/295; 100/902

[58] Field of Search ..... D15/123; 241/99; 100/233, 295, 902, 293, 35

[56] References Cited

U.S. PATENT DOCUMENTS

| | | | |
|---|---|---|---|
| 2,139,143 | 12/1938 | Wiswell | 100/902 X |
| 2,466,907 | 4/1949 | Nadolny et al. | 100/902 X |
| 2,603,270 | 7/1952 | Voigt | 100/233 |
| 2,905,079 | 9/1959 | Brock | 100/902 X |
| 3,776,129 | 12/1973 | Carlson | 100/902 X |
| 3,780,647 | 12/1973 | Reimers | 100/902 X |
| 3,853,054 | 12/1974 | Jacobsen | 100/902 X |
| 4,301,722 | 11/1981 | Balbo et al. | 100/902 X |
| 4,333,395 | 6/1982 | Kurtz | 100/233 |
| 4,333,396 | 6/1982 | Longnecker | 100/902 X |

FOREIGN PATENT DOCUMENTS

| | | | |
|---|---|---|---|
| 1156139 | 6/1969 | United Kingdom | 100/902 |

*Primary Examiner*—Billy J. Wilhite

*Attorney, Agent, or Firm*—James R. Haller

[57] ABSTRACT

A can crusher for axially crushing an empty can of the type having a recessed top and bottom and a pour hole in the top, the pour hole appearing when the tab is removed to empty the can. The present invention comprises first and second members having a hinge at one end for connecting the members in a hinged fashion. One of the members comprises a protrusion arranged for engaging the can bottom, preferably by protruding into the recessed bottom of the can. The other member comprises a pour hole protrusion for engaging the top of the can by protruding into the pour hole. The two protrusions are positioned on the respective members so that the can may be retained between the two members as the can is axially crushed by moving the unhinged ends of the members toward one another.

14 Claims, 9 Drawing Figures

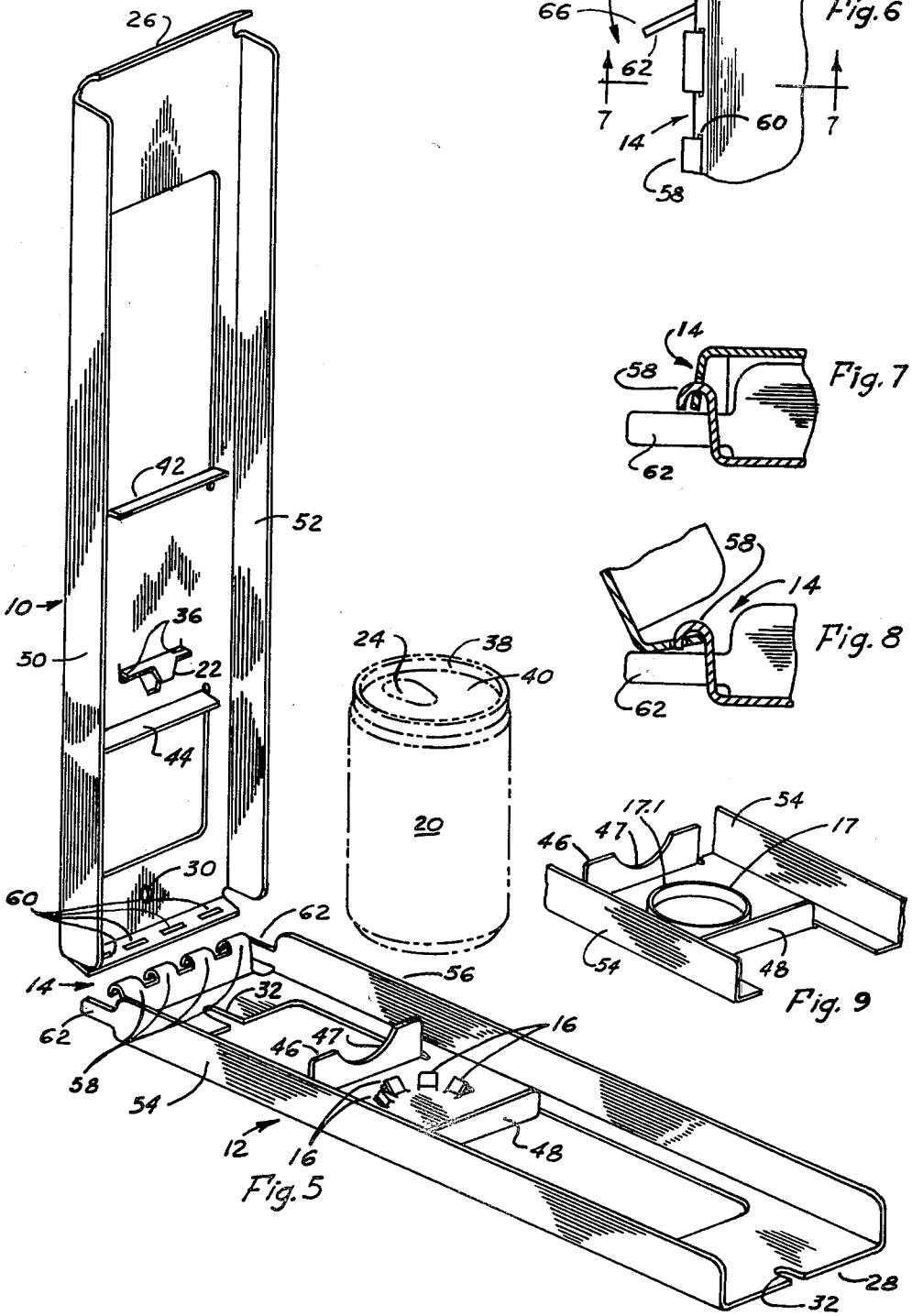
Fig. 5
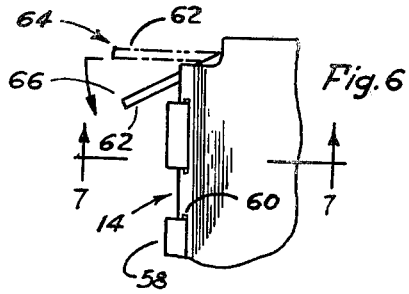
Fig. 6
Fig. 7
Fig. 8
Fig. 9

CAN CRUSHER

BACKGROUND OF THE INVENTION

The present invention is a can crusher which is particularly suited for crushing carbonated beverage cans of the type having a removable tab which when removed exposes a pour hole adjacent the periphery of one end of the can for emptying the can.

The desirability, if not the necessity, of recycling extruded aluminum and steel beverage cans as a means of conservation and environmental control has stimulated the development of can crushing devices. However, devices previously developed were generally complicated, comprising many parts, and were made of relatively heavy metal material in order to provide the strength and endurance required to perform the can crushing job satisfactorily. Further, many of these devices crushed the cans laterally rather than axially. Further, previously developed can crushing devices were difficult to disassemble for the purpose of cleaning and the like, and many required particular mounting configurations and did not fold into a compact package for easy storage or transportation. Typical examples of prior devices are disclosed in U.S. Pat. Nos. 2,466,907 (Nadolny et al.), 2,905,079 (Brock), 3,776,129 (Carlson), 3,780,647 (Reimers), 3,853,054 (Jacobsen) and 4,301,722 (Balbo et al.), and in British Patent No. 1,156,139 (Hume).

SUMMRY OF THE INVENTION

The present invention is a can crusher for axially crushing an empty can of the type having a recessed top and bottom and a pour hole in the top of the can adjacent its periphery, the hole appearing when a closure tab is removed to empty the can. The present invention comprises first and second members having interconnecting hinge means at one end for connecting the members in a hinged fashion. One of the members carries bottom engaging means for supportively engaging the bottom of a can. The other member carries pour hole engaging means for engaging the top of the can by protruding into the pour hole. The two engaging means are so positioned on the respective members as to retain a can between the two members as the can is axially crushed by moving the unhinged ends of the members toward one another.

BRIEF DESCRIPTION OF THE DRAWINGS

FIG. 5 illustrates a preferred embodiment of the present can crusher in an open, disassembled position and shown in perspective;

FIG. 6 is a broken away, top view of the embodiment of FIG. 1 showing a portion of the hinge structure;

FIG. 7 is a broken away cross sectional view, taken along line 7—7 of FIG. 6;

FIG. 8 is a view similar to that of FIG. 7 and illustrating the hinge structure in a different position; and FIG. 9 is a broken away perspective view showing a modification of the embodiment of FIG. 1.

DETAILED DESCRIPTION OF THE PREFERRED EMBODIMENT

Figure 1:
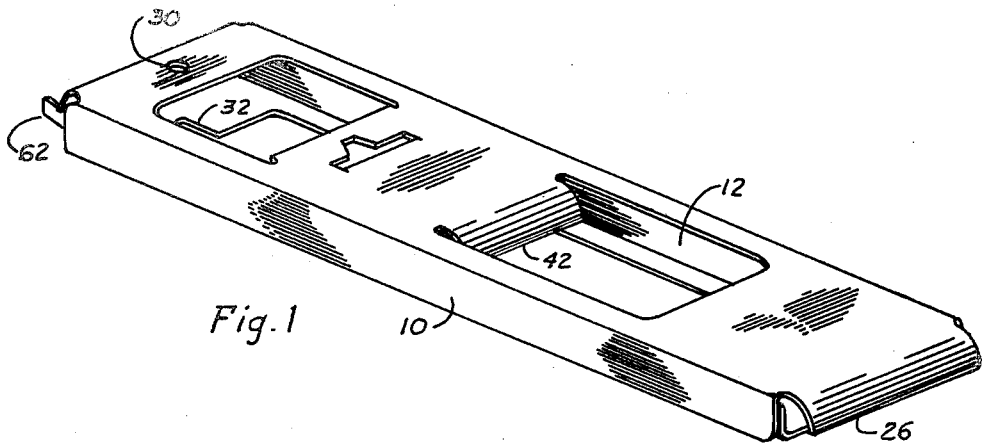
FIG. 1 is a perspective view of a preferred embodiment of the present invention in its compact form for easy transportation and storage.
Figure 3:
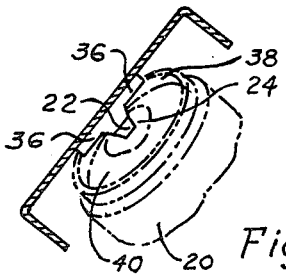
FIG. 3 is a broken away, cross sectional view taken along line 3—3 of FIG. 2.
Figure 2:
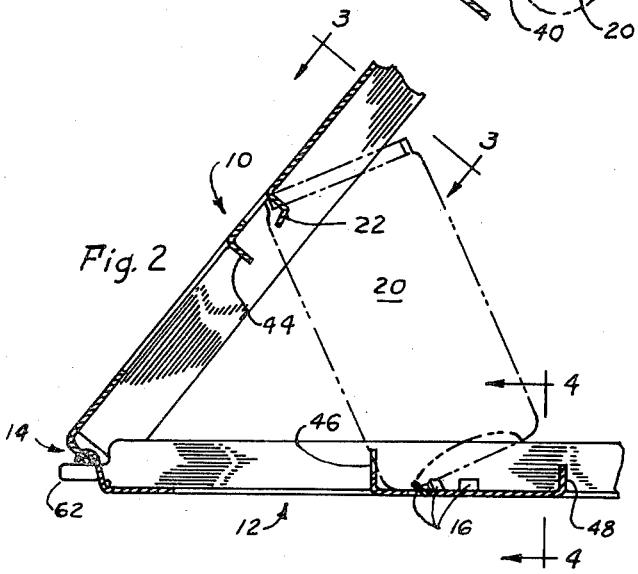
FIG. 2 is a side view, in cross section and partially broken away, of the embodiment of FIG. 1.
Figure 4:
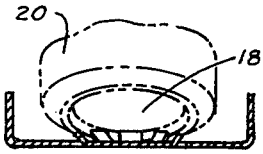
FIG. 4 is a broken away, cross sectional view taken along line 4—4 of FIG. 2.

Referring to FIGS. 2, 3, 4 and 5, the can crusher illustrated comprises a first elongated member (10) and a second elongated member (12) having a hinge (14) capable of connecting the members in a hinged fashion.

Member (12), which is the bottom member in the drawing, is provided with tabs (16) arranged in a semicircular pattern, tabs (16) forming protrusion means for engaging a can bottom by protruding into the recessed bottom (18) of the can (20). In the drawing, a can is shown in phantom lines as (20). The tabs (16) are formed by punching out and bending a portion of the sheet material from which member (12) is fabricated. Of course, tabs (16) could be secured by other ways such as by welding tabs to member (12), although this would be more complex and expensive. By forming tabs such as (16) and other elements through a punching and forming operation, the preferred embodiment of the present pressure can be entirely fabricated from two pieces of sheet material. Another example of protrusion means is shown in FIG. 9 as the formed and raised circular rim (17) which presents a generally circular supporting section 17.1 engaging the recessed bottom of a can.

Member (10) is provided with a tab (22) which forms pour hole engaging means for engaging the top of can (20) by protruding into the pour hole (24) of the can, the pour hole being formed when a closure tab of the can is opened to empty the can of its contents. Closure tabs, both the removable and the non-removable types, are well-known. Tabs (16) and (22) are positioned on members (12) and (10), respectively, so that can (20) may be retained between the two members as the can is axially crushed by moving the unhinged ends (26) and (28) of the members (10) and (12) toward one another.

In order to perform a can crushing operation, the present crusher may be mounted to or rested upon a flat surface such as a floor or a tabletop with or without mounting. Note that aperture (30) and the slots (32) are provided for easy stowage and for mounting the crusher to a wall or the like, the slots enabling the crusher to be easily removed from the wall.

The tab (22) forming the pour hole protrusion means may include a flanged portion (36) for engaging the inside diameter (38) of the rim of a can (20) formed by the recessed can top (40). The flange portion (36) provides means for engaging the rim of the can at points on either side of and preferably spaced from the pour hole (24) to substantially prevent the can (20) from rolling out of the can crusher as the crushing operation proceeds.

Each member (10) and (12) of the crusher may include additional tabs or flanges for strengthening the members and, optionally, for engaging the outside of can (20) when the top and bottom surfaces of the can become substantially parallel to members (10) and (12) as the can is crushed to further prevent the can from escaping from the crusher until the can is fully crushed. Thus, member (10) is shown having flanges (42) and (44) located diametrically opposite one another while member (12) is shown having opposed flanges (46) and (48) of which the former may support, in the recess (47), the outside diameter of the bottom of the can as it is crushed. Sidewall portions (54) and (56) of member (12) further serve to confine the can (20) during the crushing operation but primarily provide strength to members (10) and (12). The cut-out or recessed portions adjacent the flanges (42), (44), (46) and (48) reduce the weight of the crusher without significant loss in strength, and the inwardly turned flanges and particularly flange (26) and (42) provide a smooth surface for palm contact.

In one embodiment of the invention, hinge (14) permits members (10) and (12) to become unconnected for the purposes of cleaning and the like. As illustrated, hinge (14) is formed at the two adjacent ends of members (10) and (12), member (12) having an end formed with curved tabs (58), and member (10) having apertures (60) for receiving the curved tabs (58).

In the preferred embodiment, the hinge means includes locking means for locking the halves of the hinge together so as to maintain hinged engagement of the ends of the members. In the drawing, the locking means is typified as including a pair of bendable tabs (62) formed as parts of the member (12), the tabs having a first position (shown as (64) in FIG. 6) permitting the hinge (14) to be assembled or disassembled. The tab (62) further has a second position (shown as (66) in FIG. 7) securing the engagement of the ends of the members (10) and (12). In the embodiment illustrated, tabs (62) are formed as parts of member (12) and are bent to achieve their second or locking positions. As shown in FIGS. 7 and 8, the tabs (62), in their locked position, may extend beneath the hinged end of member (10) to support the latter in an open position (FIG. 8) when the crusher rests in a horizontal position on a table or the like.

The tabs (16) or annular rim segment 17.1 or the like formed for supporting a can at its bottom merely engage but do not pierce the can bottom. In the preferred embodiment, the device of the invention is free from protrusions or other elements capable of piercing the bottom of the can during the crushing operation. Further, edges of the openings adjacent especially the tabs (42) and (44) may be bent or curved inwardly slightly to lend additional strength to the structure.

While a preferred embodiment of the present invention has been described, it should be understood that various changes, adaptations and modifications may be made therein without departing from the spirit of the invention and the scope of the appended claims. For example, although the present invention is shown as simply fabricated from two pieces of sheet material, a more complex embodiment comprising bar stock and other piece parts could be employed.

What is claimed is:

1. A can crusher for axially crushing an empty can of the type having a recessed top and bottom and a pour hole in the top adjacent its periphery, the hole appearing when a closure tab is opened to empty the can, comprising:

(a) means defining first and second members each having interconnecting hinge means at one end for connecting the members at their ends in a hinged fashion;

(b) bottom protrusion means carried by one member and arranged to engage a can bottom by protruding into the recessed bottom of the can;

(c) pour hole engaging means carried by the other member for engaging the top of a can by protruding into the pour hole; and (d) the bottom protrusion means and the pour hole engaging means being positioned on the respective members so that a can may be retained between the two members as the can is axially crushed by moving the unhinged ends of the members toward one another.

2. The apparatus of claim 1 including rim contacting means carried by the other member for engaging the inner surface of the can rim formed by the recessed can top so as to substantially prevent a can from rolling out of the can crusher during the crushing operation.

3. A can crusher for axially crushing an empty can of the type having a recessed top and bottom and a pour hole in the top adjacent its periphery, the hole appearing when a closure tab is opened to empty the can, comprising:

(a) means defining first and second members each having interconnecting hinge means at one end for connecting the members at their ends in a hinged fashion;

(b) bottom protrusion means carried by one member and arranged to engage a can bottom by protruding into the recessed bottom of the can;

(c) pour hole engaging means carried by the other member for engaging the top of a can by protruding into the pour hole;

(d) rim-contacting means carried by the other member for engaging the inner surface of the can rim formed by the recessed can top so as to substantially prevent a can from rolling out of the can crusher during the crushing operation;

(e) retaining tab means carried by at least one of the members for supportively engaging the outside of a can when the top and bottom surfaces of the can become substantially parallel as the can is crushed; and (f) the bottom protrusion means and the pour hole engaging means being positioned on the respective members so that a can may be retained between the two members as the can is axially crushed by moving the unhinged ends of the members toward one another.

4. The apparatus of claim 1 wherein the interconnecting hinge means is so constructed and arranged as to permit the members to become disassembled for cleaning and the like.

5. A can crusher for axially crushing an empty can of the type having a recessed top and bottom and a pour hole in the top adjacent its periphery, a hole appearing when a closure tab is opened to empty the can, comprising:

(a) means defining first and second members each having interconnecting hinge means at one end for connecting the members at their ends in a hinged fashion; the hinge means including one or more curved tabs carried at the end of one of the members and corresponding apertures carried at the adjacent ends of the other member for engaging the curved tab;

(b) bottom protrusion means carried by one of the members and arranged to engage a can bottom by protruding into the recessed bottom of the can;

(c) pour hole engaging means carried by the other member for engaging the top of a can by protruding into the pour hole; and (d) the bottom protrusion means and the pour hole engaging means being positioned on the respective members so that a can may be retained between the two members as the can is axially crushed by moving the unhinged ends of the members toward one another.

6. The apparatus of claim 5 wherein the hinge means further comprises locking means for locking the interconnecting hinge means together so that the curved tabs remain engaged with the apertures.

7. The apparatus of claim 6 wherein the locking means comprises locking tab means carried by one of the members and having a first position permitting the hinge means to be assembled or disassembled and a second position preventing the hinge from being disassembled.

8. The apparatus of claim 7 wherein the locking tab means defines support means for engaging and supporting the first member in an open position with respect to the second member.

9. A can crusher for axially crushing an empty can of the type having an upper rim at its top and a pour hole in the top adjacent the rim, comprising means defining first and second elongated members each having interconnecting hinge means at one of their ends for connecting the members at their ends in a hinged fashion; bottom engaging means carried by one member for supportively engaging the bottom of a can; pour hole engaging means carried by the other member for engaging the top of the can and including means for protruding into the pour hole; the bottom engaging means and pour hole engaging means being so positioned on the respective elongated members as to retain a can between the two members as the can is axially crushed by moving unhinged ends of the members toward one another.

10. The can crusher of claim 9 including rim contacting means positioned adjacent the pour hole engaging means for supportively engaging the rim of a can on either side of its pour hole.

11. A method of axially crushing an empty can of the type having a recessed top and bottom and a pour hole in the top adjacent its periphery, the hole appearing when a closure tab is opened to empty the can, comprising:

(a) providing a first member hingeably connected to a second member;

(b) inserting a pour hole engaging means carried by the first member into the pour hole;

(c) inserting a bottom protrusion carried by the second member into the recessed bottom of the can so that the can is retained between the two members; and (d) hingeably compressing the two members to axially crush the can.

12. The method of claim 11 further comprising inserting a rim contacting means carried by the first member into the top recess of the can to engage the can rim so as to prevent the can from rolling out from between the members during the crushing step.

13. The method of claim 12 including the step of supportively engaging the outside of the can when the top and bottom surfaces of the can become substantially parallel as the can is crushed.

14. The method of claim 11 further comprising the step of disconnecting the two members of the hinge after the can has been crushed for cleaning and the like.

* * * * *